US009926776B2

(12) United States Patent
Zha et al.

(10) Patent No.: US 9,926,776 B2
(45) Date of Patent: Mar. 27, 2018

(54) CHARACTERIZATION OF WHIRL DRILLING DYSFUNCTION

(71) Applicant: CONOCOPHILLIPS COMPANY, Houston, TX (US)

(72) Inventors: Yang Zha, Houston, TX (US); Phil D. Anno, Houston, TX (US); Stephen K. Chiu, Katy, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 34 days.

(21) Appl. No.: 15/186,012

(22) Filed: Jun. 17, 2016

(65) Prior Publication Data

US 2016/0369612 A1 Dec. 22, 2016

Related U.S. Application Data

(60) Provisional application No. 62/181,559, filed on Jun. 18, 2015.

(51) Int. Cl.

| | |
|---|---|
| ***E21B 44/02*** | (2006.01) |
| ***E21B 47/00*** | (2012.01) |
| ***E21B 3/00*** | (2006.01) |
| ***G01B 21/24*** | (2006.01) |
| ***E21B 44/00*** | (2006.01) |

(52) U.S. Cl.
CPC ..... *E21B 44/00* (2013.01)

(58) Field of Classification Search
CPC ..... E21B 44/00
See application file for complete search history.

(56) References Cited

U.S. PATENT DOCUMENTS

| | | | | |
|---|---|---|---|---|
| 7,596,481 | B2 | 9/2009 | Zamora et al. | |
| 2013/0049981 | A1 | 2/2013 | MacPherson et al. | |
| 2013/0245950 | A1 | 9/2013 | Jain | |
| 2013/0248247 | A1 | 9/2013 | Sugiura | |
| 2015/0101865 | A1* | 4/2015 | Mauldin | E21B 44/00 175/40 |
| 2016/0115778 | A1* | 4/2016 | van Oort | E21B 7/0006 175/27 |

(Continued)

OTHER PUBLICATIONS

International Search Report for parent case, App. No. PCT/US2016/038167, dated Sep. 15, 2016.

(Continued)

*Primary Examiner* — D. Andrews
*Assistant Examiner* — Dany E Akakpo
(74) *Attorney, Agent, or Firm* — ConocoPhillips Company

(57) ABSTRACT

Methods and systems output at least one drill string whirl attribute, such as magnitude, orientation, velocity and type, without requiring determination of whirl frequency. Transforming acceleration data into drill string motions provides a path of one point along the drill string. Fitting these motions throughout one complete revolution of the drill string to a revolution ellipse, for example, provides revolution ellipse centers defining centers of rotation for each revolution fitted. A whirl ellipse, for example, derives from another fitting using a plurality of the revolution ellipse centers. Coefficients from the whirl ellipse and/or vector direction of the centers provide at least one whirl attribute for output.

20 Claims, 8 Drawing Sheets

(56) References Cited

U.S. PATENT DOCUMENTS

2016/0334306 A1 11/2016 Chiu

OTHER PUBLICATIONS

Brett, J.F., Warren, T.M., Behr, S.M., 1989. Bit Whirl: A Theory of PDC Bit Failure. Paper SPE 19571 presented at the SPE Annual Technical Conference and Exhibition held in San Antonio, TX, Oct. 8-11.

Jansen, J.D., 1990. Whirl and Chaotic Motion of Stabilized Drill Collars. Paper SPE 20930 presented at the European Petroleum Conference held in the Hague, Netherlands, Oct. 22-24.

* cited by examiner

CHARACTERIZATION OF WHIRL DRILLING DYSFUNCTION

CROSS-REFERENCE TO RELATED APPLICATIONS

This application is a non-provisional application which claims benefit under 35 USC § 119(e) to U.S. Provisional Application Ser. No. 62/181,559 filed Jun. 18, 2015, entitled "CHARACTERIZATION OF WHIRL DRILLING DYSFUNCTION," which is incorporated herein in its entirety.

STATEMENT REGARDING FEDERALLY SPONSORED RESEARCH OR DEVELOPMENT

None.

FIELD OF THE INVENTION

Embodiments of the invention relate to systems and methods for determining whirl attributes of a rotating drill string, which may be used in hydrocarbon drilling operations.

BACKGROUND OF THE INVENTION

Hydrocarbon reservoirs are developed with drilling operations using a drill bit associated with a drill string rotated from the surface or using a downhole motor, or both using a downhole motor and also rotating the string from the surface. A bottom hole assembly (BHA) at the end of the drill string may include components such as drill collars, stabilizers, drilling motors and logging tools, and measuring tools. A BHA is also capable of telemetering various drilling and geological parameters to the surface facilities.

Resistance encountered by the drill string in a wellbore during drilling causes significant wear on the drill string, especially the drill bit and the BHA. Understanding how the geometry of the wellbore affects resistance on the drill string and the BHA and managing the dynamic conditions that lead potentially to failure of downhole equipment is important for enhancing efficiency and minimizing costs for drilling wells. Various conditions referred to as drilling dysfunctions that may lead to component failure include excessive torque, shocks, bit bounce, induced vibrations, bit whirl, stick-slip, among others. These conditions must be rapidly detected so that mitigation efforts are undertaken as quickly as possible, since some dysfunctions can quickly lead to tool failures.

One common observed dysfunction includes whirl, which often causes failures in the BHA and damages the drill bit. Whirl refers to a lateral vibration where the rotational axis of the bit does not align with the center of the borehole, and the bit center performs additional rotations around the borehole. Three distinct whirl forms include: (1) backward whirl where the drill string rotates clockwise and the center of the drill string rotates counter-clockwise around the borehole; (2) forward whirl where both drill string and drill-pipe center rotate clockwise but with different rotational speeds; and (3) chaotic whirl where the drill-pipe center does not follow a particular direction but moves in a random and highly unstable fashion.

Tri-axial accelerometers used in the drilling industry measure three orthogonal accelerations related to shock and vibration during drilling operations. The magnitudes of the acceleration data provide a qualitative evaluation of the extent of the drill string vibration. The acceleration data combined with other information may produce a qualitative drilling risk index.

However, prior approaches for quantifying whirl require estimations based on frequency domain computations. This use of the whirl frequency rather than only time domain fails to provide robust results. For example, signal noise may introduce additional peaks in the frequency spectrum and thus limit ability to make accurate determinations of whirl frequency.

Therefore, a need exists for systems and methods to provide reliable determinations of drill string whirl attributes, such as magnitude, orientation and velocity.

BRIEF SUMMARY OF THE DISCLOSURE

For one embodiment, a method of determining a whirl attribute of a drill string includes estimating centers of rotation on the drill string based on acceleration sensed per revolution for each of the centers being estimated. The method includes determining the whirl attribute from information provided by the centers of rotation. The whirl attribute output includes at least one of magnitude, orientation, velocity and type of whirl.

In one embodiment, a system for determining a whirl attribute of a drill string includes a drilling rig coupled to the drill string extending into a borehole and a sensor disposed on the drill string to detect acceleration. A processor couples to receive data from the sensor and is configured to determine the whirl attribute by estimating centers of rotation on the drill string based on the data per revolution for each of the centers being estimated. The processor derives from the centers of rotation at least one of magnitude, orientation, velocity and type of whirl.

BRIEF DESCRIPTION OF THE DRAWINGS

The foregoing and other objects, features, and advantages of the disclosure will be apparent from the following description of embodiments as illustrated in the accompanying drawings, in which reference characters refer to the same parts throughout the various views. The drawings are not necessarily to scale, emphasis instead being placed upon illustrating principles of the disclosure.

DETAILED DESCRIPTION OF THE DISCLOSURE

Embodiments of the invention relate to methods and systems for outputting at least one drill string whirl attribute, such as magnitude, orientation, velocity and type, without requiring determination of whirl frequency. Transforming acceleration data into drill string motions provides a path of one point along the drill string. Fitting these motions throughout one complete revolution of the drill string to a revolution ellipse, for example, provides revolution ellipse centers defining centers of rotation for each revolution fitted. A whirl ellipse, for example, derives from another fitting using a plurality of the revolution ellipse centers. Coefficients from the whirl ellipse and/or vector direction of the centers provide at least one whirl attribute for output. While described with respect to drilling, the output may apply to other rotating equipment problems as well and may be used in any application for proactive detection of temporal events in automated systems to aid in avoiding failures.

The present disclosure is described below with reference to block diagrams and operational illustrations of methods and devices. It is understood that each block of diagrams or operational illustrations, and combinations of blocks in the diagrams or operational illustrations, can be implemented by means of analog or digital hardware and computer program instructions. For the purposes of this disclosure a computer readable medium (or computer-readable storage medium/media) stores computer data, which data can include computer program code (or computer-executable instructions) that is executable by a computer, in machine readable form.

Figure 1:
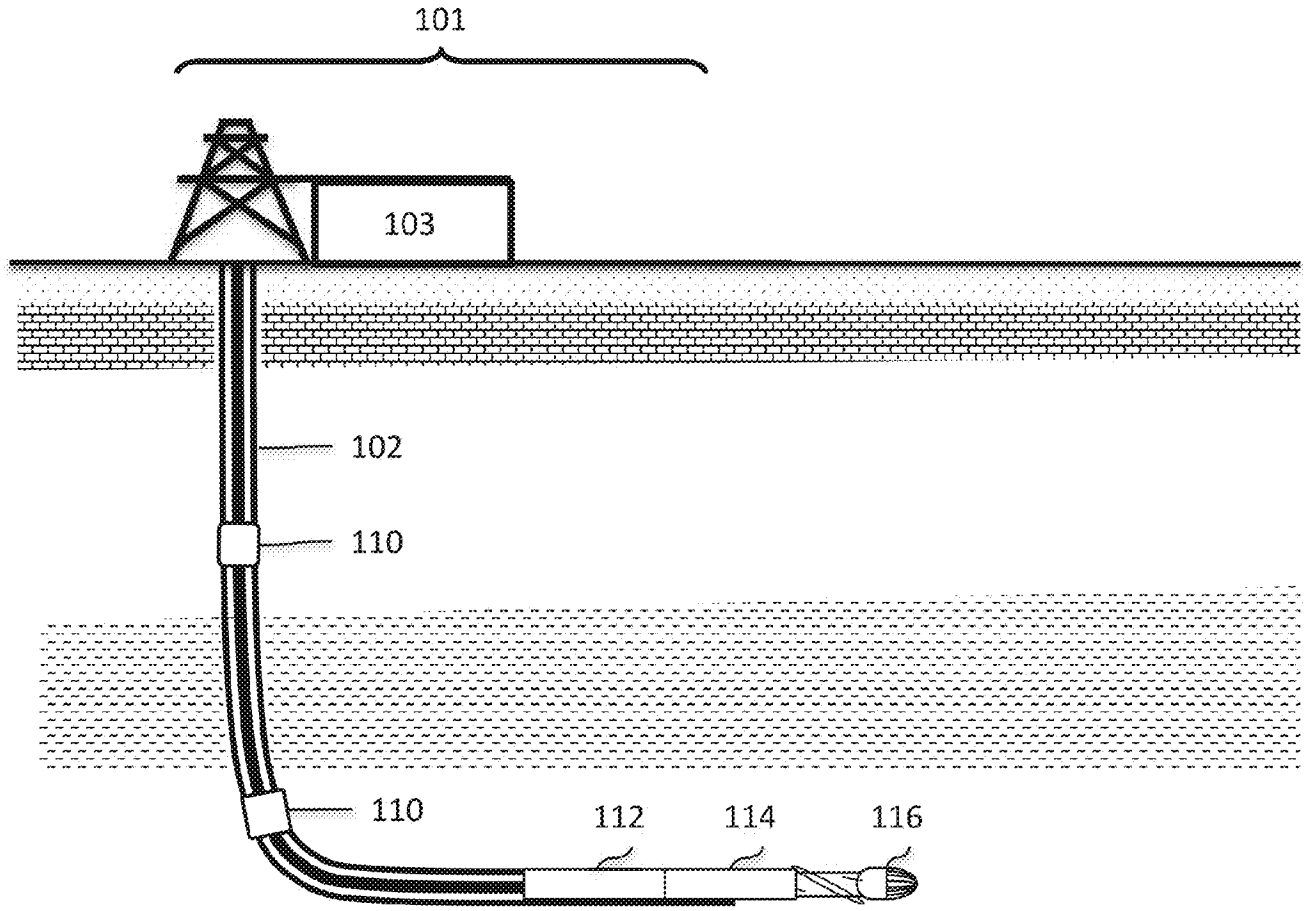
FIG. 1 depicts a well drilling operation with a whirl determination system, according to one embodiment of the invention.

FIG. 1 illustrates surface drilling rig facilities 101 used to recover hydrocarbons from a subterranean formation with a well bore 102. The surface drilling rig facilities 101 include a drilling rig and associated control and supporting facilities including processor 103, which may include data aggregation and data processing infrastructure described further herein as well as drill rig control facilities. During drilling operations the well bore 102 includes a drill string comprising a bottom hole assembly (BHA) that may include a mud motor 112, an adjustable bent housing or 'BHA Dynamic Sub' 114 containing various sensors and electronic components and a drill bit 116.

The BHA Dynamic Sub 114 acquires data including tri-axial acceleration data from respective sensors. Any data acquired with the BHA Dynamic Sub 114 may be transmitted to the drilling rig facilities 101 through drill string telemetry or through mud-pulse telemetry as time series data. The drill string may also contain associated sensors, for example mid-string dynamic subs 110, acquiring data utilized in some embodiments for determining drill string whirl attributes, and these instrumented subs can also send signals representing these measurements up the drill string where they are recorded on or near the drilling rig.

Figure 2A:
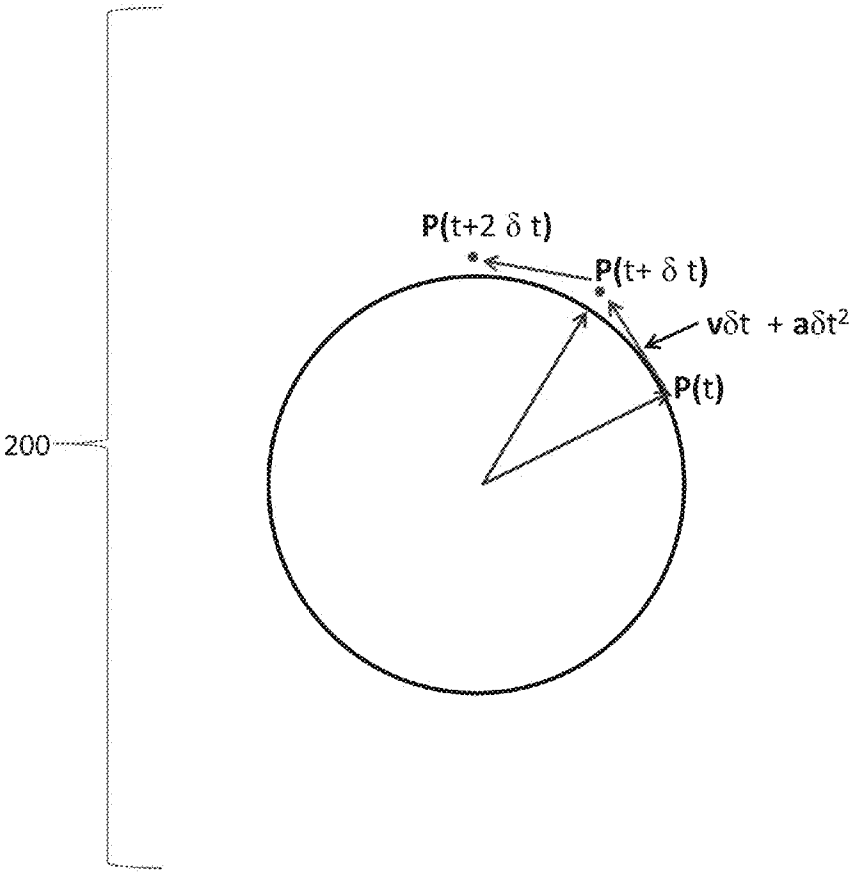
FIG. 2A depicts a vector representation of circular drill string positions at various times for a discrete point of the drill string, according to one embodiment of the invention.

FIG. 2A provides a vector representation 200 of circular drill string positions. In one embodiment, continuous drill string position determination uses three-orthogonal accelerations. The relationship between continuous drill string position and acceleration is:

$$\frac{\partial^2 P(x, y, z, t)}{\partial t^2} = \alpha(x, y, z, t) \tag{1}$$

where P(x, y, z, t) is a position vector in a global stationary coordinate frame referenced at the center of the drill string, a(x, y, z, t) is an acceleration vector in a global stationary coordinate frame referenced at the center of the drill string, and t is the travel time of the drill string motion.

For one embodiment, the solution to equation 1 can be written in a double integral form as:

$$P(x,y,z,t+dt)=\iint a(x,y,z,t)dt^2 \tag{2}$$

where dt is the time interval the drill string moves from P(x, y, z, t) to P(x, y, z, t+dt). If dt is small and typically equal to the data sample rate in the range of 0.01 to 0.0025 sec, the a(x,y,z,t) vector can be approximated to be constant within a small time interval. Equation 2 becomes:

$$P(x,y,z,t+dt)=P(x,y,z,t)+v(x,y,z,t)\delta t+a(x,y,z,t)\delta t\hat{}2, \tag{3}$$

where v(x,y,z,t)=Σa(x,y,z,t)dt, and δt is the time interval the drill string moves from P(x, y, z, t) to P(x, y, z, t+dt). The drill string positions can be continuously determined using equation 3.

Since low frequency noise in the acceleration data may lead to slow drifting of positions calculated using equation 3, some embodiments solve equation 1 through a numerical optimization to calculate drill string position. An objective function for the drill string position is thus constructed from equation 1 and is:

$$J(P) = \left\| \frac{\partial^2 P(t)}{\partial t^2} - \alpha(t) \right\|^2 + \lambda D(P) \tag{4}$$

where D(P) is a damping function such that D(P) increases significantly when $|P|>R_p$ (i.e., drill string position is outside of the wellbore) given $R_p$ is the radius of the drill string where the sensor is mounted and λ is a constant scaler to control the relative importance of the data misfit (first term) and the damping function. An example form of D(p) is:

$$D(P) = \exp\left(\frac{P^2}{R_p^2} - 1\right) \tag{5}$$

A search for the correct drill string position that satisfies the acceleration data utilizes an iterative search on P to find the P that minimizes the objective function J(P) of equation 4. While one implementation uses a linearized quasi-Newton method to perform the iterative search, other exemplary suitable search methods include steepest descent or Monte Carlo.

In general, the recorded acceleration data include both the earth's gravitational and centripetal accelerations. Both accelerations should be accounted for before applying equation 3. Difficulty in obtaining exact locations and orientations of the downhole tri-axial accelerometers at a particular instance of time because of buckling and bending of the drill string make estimates for the exact gravitational and centripetal accelerations as a position of drilling depth challenging. A simple, but effective method to correct both gravitational and centripetal accelerations includes approximating both corrections by a local running mean of the acceleration data. After removing the local running mean, the acceleration data yield the measurements due to the vibration only.

Figure 2B:
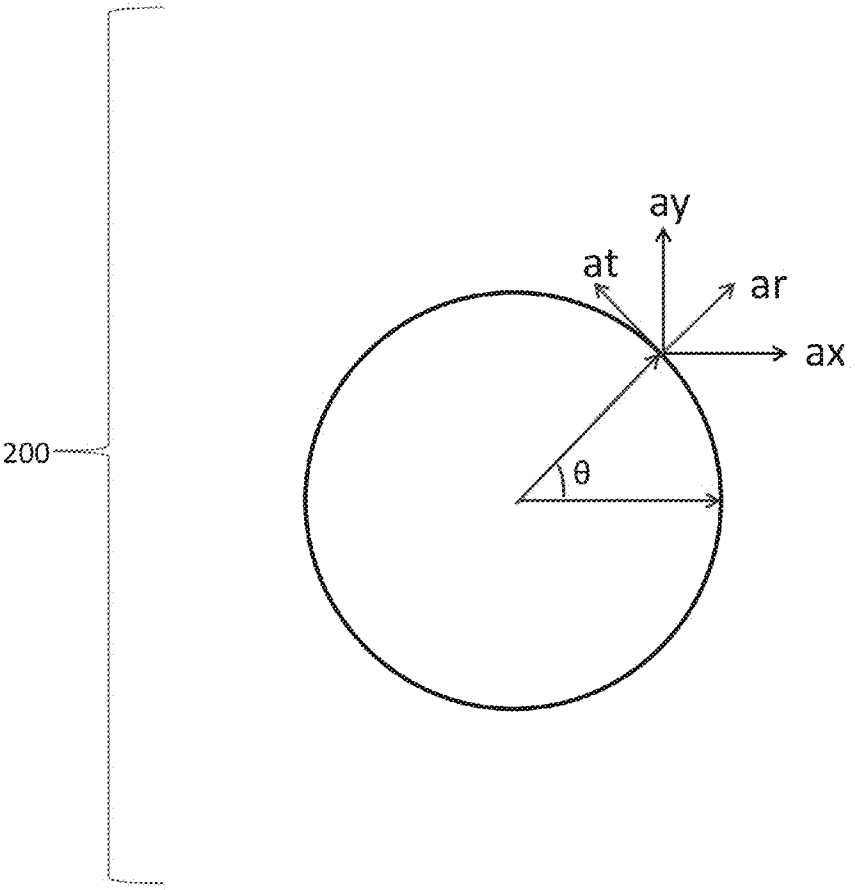
FIG. 2B depicts a transformation of acceleration data from a local moving coordinate frame to a global stationary coordinate frame to compute drill string motions in order to determine whirl attributes, according to one embodiment of the invention.

FIG. 2B illustrates the transformation of acceleration data from a local moving coordinate frame to a global stationary coordinate frame. Equation 3 also requires the acceleration data to be in a stationary coordinate frame. For standard drilling operations, the tri-axial accelerometers mount on the drill string. The tri-axial accelerometers rotate with the drill string. Thus, the recorded acceleration data is in a local rotating coordinate frame. It is necessary to transform from the local rotating coordinate frame to a global stationary coordinate frame. However, since the tri-axial accelerometers are rigidly mounted on the drill string, the axial acceleration in the local rotating coordinate frame is equivalent to a stationary coordinate frame. Thus, the coordinate transformation reduces to a 2-D rotation in X-Y plane.

$$\begin{pmatrix} ax(t) \\ ay(t) \\ az(t) \end{pmatrix} = \begin{pmatrix} \cos\theta & -\sin\theta & 0 \\ \sin\theta & \cos\theta & 0 \\ 0 & 0 & 1 \end{pmatrix} \begin{pmatrix} ar(t) \\ at(t) \\ az(t) \end{pmatrix} \tag{6}$$

where ar, at and az are radial, tangential and axial accelerations in a local moving coordinate frame; ax, ay and az are the corresponding accelerations in a global stationary coordinate frame; θ is the rotational angle (See FIG. 2B).

A conventional approach to estimate the rotational angle θ uses the vector dot product between acceleration vectors ax and ar. A better and more accurate method uses downhole RPM measurements to compute θ as:

$$\theta = \omega \delta t \tag{7}$$

where ω is angular velocity of downhole RPM at a particular instance of time, and where δt is the time interval the drill string moves from P(x, y, z, t) to P(x, y, z, t+dt).

Figure 3:
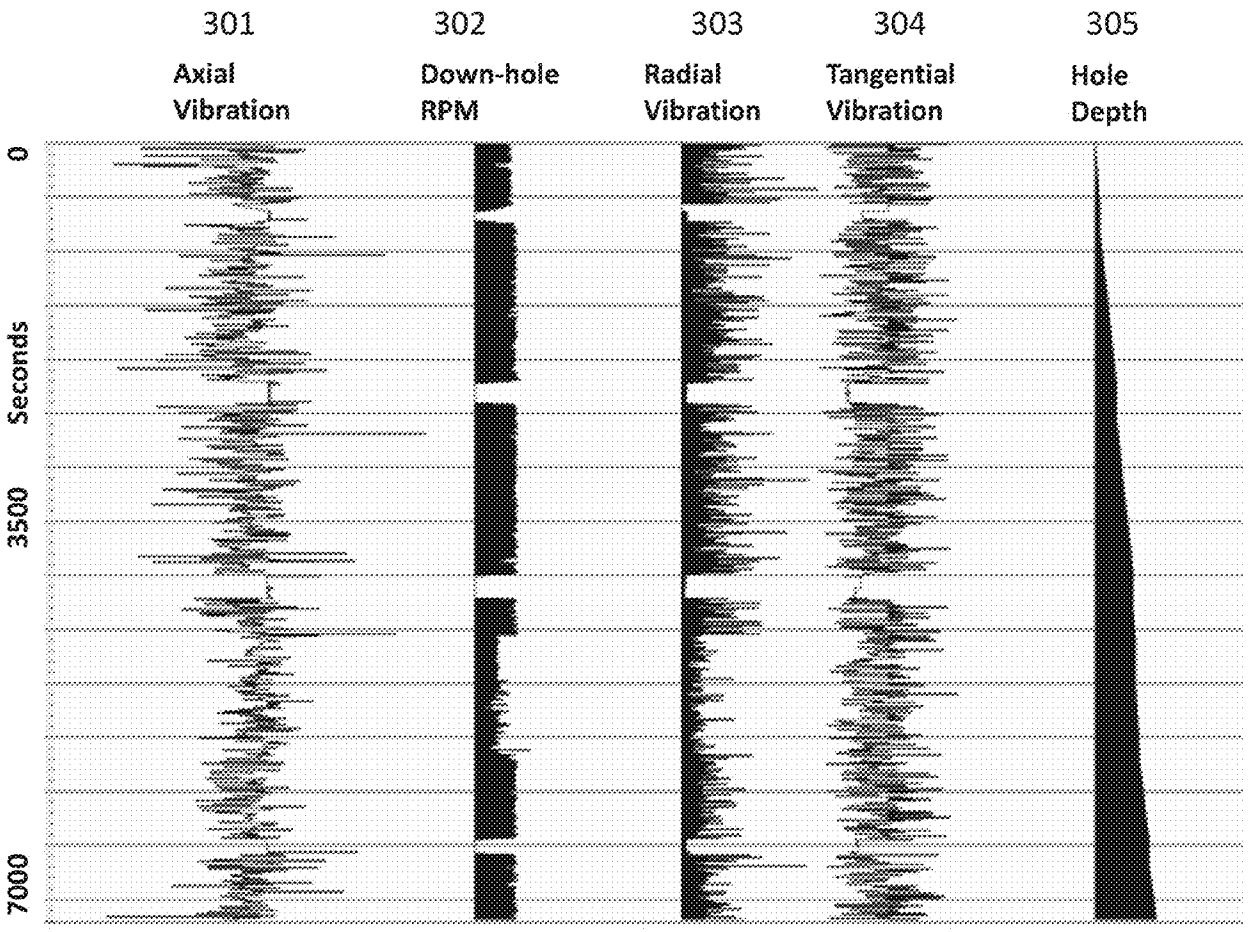
FIG. 3 depicts exemplary input data to be used in computing the drill string motion for each drill string revolution with data channel 1 representing axial vibration and data channels 3 and 4 representing the polar coordinates of the radial and tangential vibrations, according to one embodiment of the invention.

FIG. 3 shows input data including data channel 1—axial vibration 301, representing axial acceleration; data channel 2—down-hole rotations per minute (RPM) 302; data channel 3—radial vibration 303, representing the polar coordinates of radial acceleration; and data channel 4—tangential vibration 304, representing the polar coordinates of tangential acceleration. Data channel 5 presents measured hole depth 305.

For some embodiments, transforming tri-axial accelerations into drill string motions includes the following three steps: (1) approximating the gravitational and centripetal accelerations by a local running mean of the acceleration data and removing the local running mean to yield the acceleration measurements due to the vibration only, (2) transforming the corrected acceleration data from a local rotating coordinate frame to a global stationary coordinate frame using equation 6, and (3) mapping the acceleration data into continuous drill string positions via equation 3. In some embodiments, transforming tri-axial accelerations into drill string motions includes an iterative search on P to find the P that minimizes the objective function J(P) of equation 4 and that is then mapped into continuous drill string positions.

Figure 4:
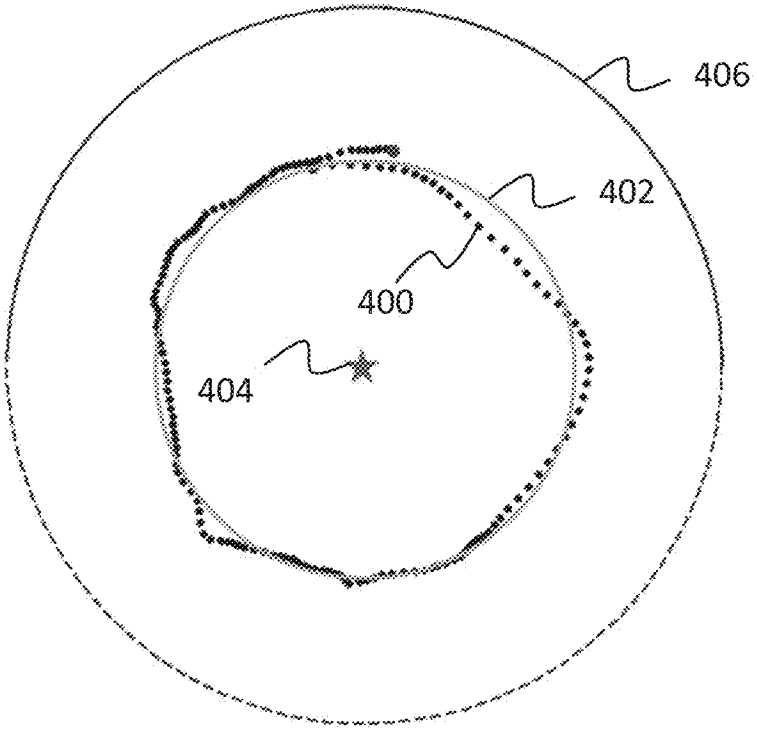
FIG. 4 depicts an axial view of the drill string motions computed, as shown by dots, and fitted to a revolution ellipse, as shown by a line, for a complete revolution of the drill string, according to one embodiment of the invention.

FIG. 4 illustrates the drill string motions computed from this numerical optimization, as shown by dots 400, and fitted to a revolution ellipse 402, as shown by a line, for a complete revolution of the drill string inside the wellbore 406. In some embodiments, a least-squares fitting algorithm may fit the drill-string motions within a complete drill-string revolution to the revolution ellipse 402, defined as:

$$Ax^2+Bxy+Cy^2+Dx+Ey+F=0, \tag{8}$$

with an ellipse-specific constraint of:

$$4AC-B*B=1, \tag{9}$$

where A, B, C, D, E, and F are the coefficients of the ellipse, and x and y are the coordinates of drill-string motion. The least-squares algorithm fits the drill string motions within a complete revolution to derive the coefficients of A, B, C, D, E and F. The coefficients of the ellipse, in turn, yield the major and minor axes, rotational angle, and center 404 of the revolution ellipse 402.

Figure 5:
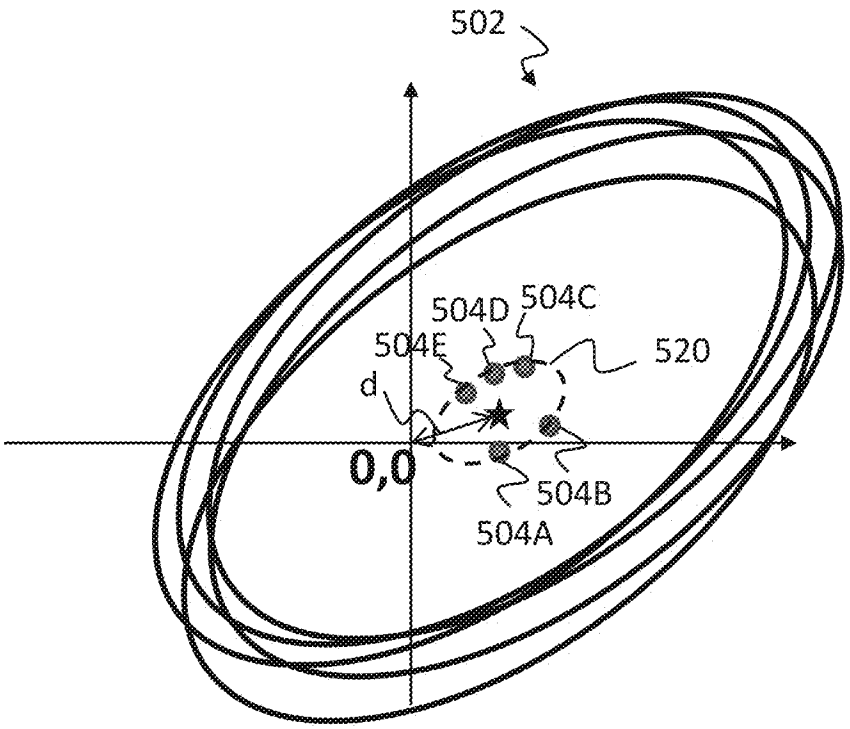
FIG. 5 depicts an axial view of exemplary revolution ellipses fitted to data to define the drill string motions for complete revolutions of the drill string with centers of the revolution ellipses shown by dots, which are fitted to a whirl ellipse shown by a dashed line and indicative of whirl magnitude, orientation and velocity, according to one embodiment of the invention.

FIG. 5 shows five revolution ellipses 502 fitted from data with each of the revolution ellipses 502 having centers 504A-E shown by dots, which may also be fitted by a least-squares algorithm to a whirl ellipse 520 shown by a dashed line. Given ellipse equations 8 and 9 include five independent parameters, deriving the whirl ellipse 520 may utilize at least five of the centers 504A-E. In some embodiments, the whirl ellipse 520 updates with continuous fitting to sensed data of another revolution of the drill string replacing oldest sensed data used in prior determinations of the whirl ellipse 520 and thus may provide real-time results.

The whirl ellipse 520 provides whirl magnitude, orientation and velocity. Whirl orientation corresponds to rotational angle of the whirl ellipse 520 obtained from the coefficients set forth in the ellipse equations 8 and 9. For some embodiments, a whirl magnitude equation defines extent of the whirl as:

$$\text{whirl magnitude} = d/(R-r), \tag{10}$$

where d (shown in FIG. 5) is the distance from origin (i.e., a central axis of the borehole forming the well bore 102 shown in FIG. 1) to a center of the whirl ellipse 520 (shown as a star in FIG. 5), R is the radius of the borehole, and r is the radius of pipe forming the drill string.

In some embodiments, the whirl magnitude is defined as the ratio between the drill string's kinetic energy for the whirl motion and of the normal rotation, in dB scale:

$$\text{whirl magnitude} = \log_{10}\left(\frac{2R_{whirl}^2\omega_{whirl}^2}{(R_o^2+R_i^2)\omega_{drilling}^2}\right), \tag{11}$$

where $R_{whirl}$ is the radius of the whirl motion, calculated by the geometric average of the semi-major and semi-minor axis of the whirl ellipse 520: $R_{whirl}=\sqrt{ab}/2$ given a is major axis of the ellipse and b is minor axis of the ellipse; $R_i$ and $R_o$ are the inner and outer radius of the drill pipe where the acceleration sensor is mounted; $\omega_{whirl}$ is the angular velocity of the whirl motion determined by the ellipse centers 504A-E, with $\omega_{whirl}>0$ corresponding to a whirl motion in the direction of the drilling rotation (forward whirl); and $\omega_{drilling}$ is the angular velocity of the drill string rotation.

In some embodiments, a whirl velocity equation defines the whirl cycles per unit of time by:

$$\text{whirl ellipse perimeter}/T, \tag{12}$$

where T is the average of total travel time observed per revolution to restart the whirl ellipse, and the ellipse perimeter is approximated by:

$$\pi(a+b)(1+3h/(10+\sqrt{4-3h})) \quad (13)$$

where a is the major axis of the ellipse, b is the minor axis of the ellipse, and $$h=(a-b)2/(a+b)2. \quad (14)$$

Figure 6:
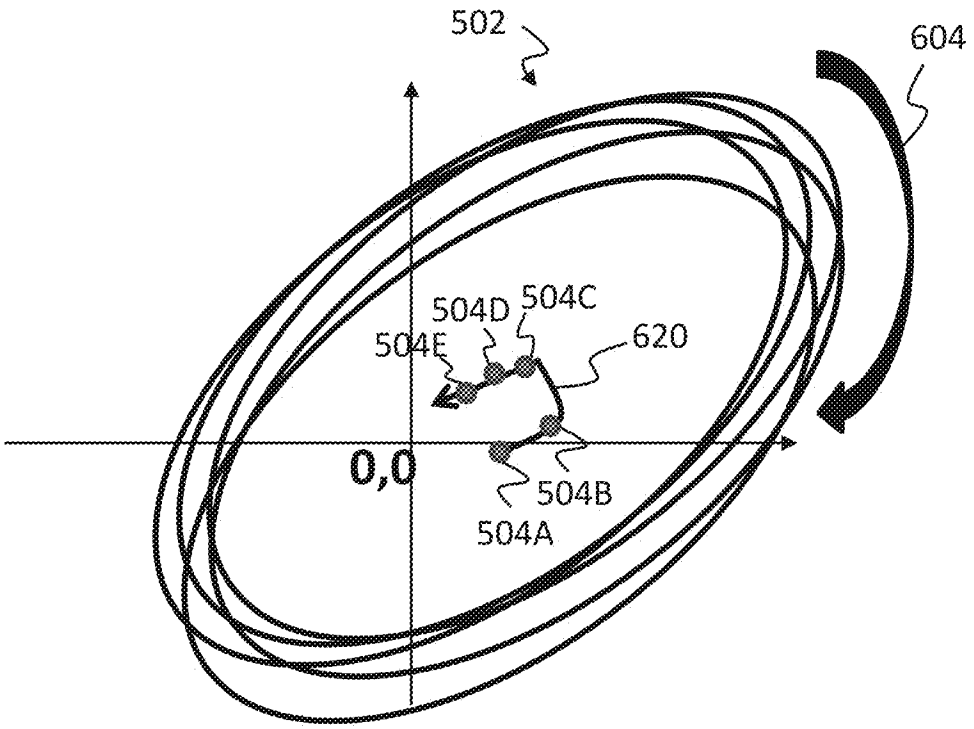
FIG. 6 depicts an axial view of the centers of the revolution ellipses shown in FIG. 5 with vector direction illustrated to determine whirl direction shown opposite to drill string rotation, according to one embodiment of the invention.

FIG. 6 depicts the centers of revolution ellipses 504A-E shown in FIG. 5 with vector direction 620 illustrated to determine whirl direction shown by example opposite to drill string rotation 604. The vector direction 620 thereby identifies type of whirl motion, which is depicted as backward whirl. The vector direction 620 takes account of succession in time given a first center of revolution ellipse 504A, a second center of revolution ellipse 504B, a third center of revolution ellipse 504C, a fourth center of revolution ellipse 504D and a fifth center of revolution ellipse 504E correspond to respective earlier through later drill string revolutions.

Figure 7:
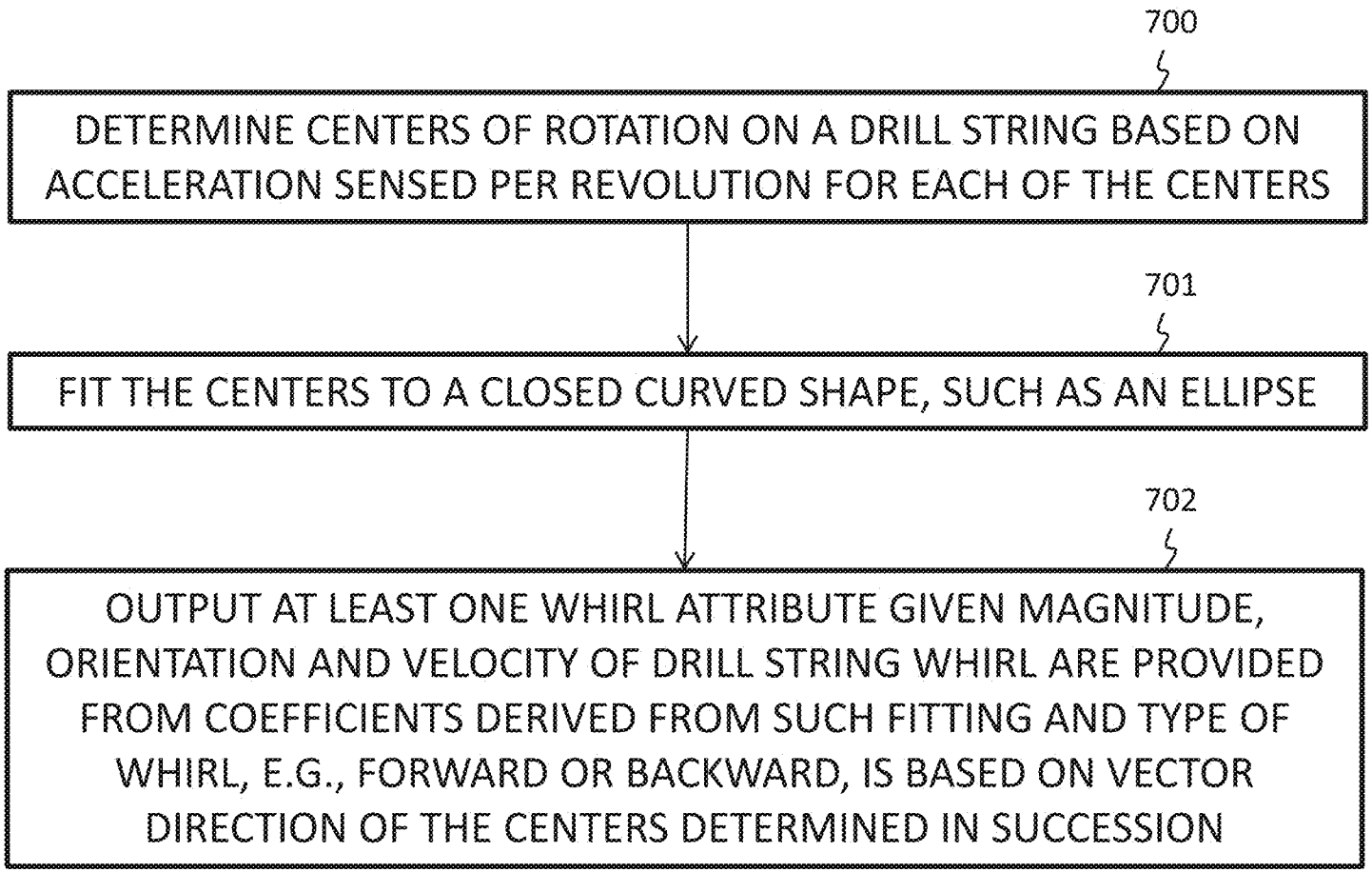
FIG. 7 depicts a flow chart of a method for the whirl determination, according to one embodiment of the invention.

FIG. 7 depicts an exemplary flow chart of a method for the whirl determination as described herein with respect to FIGS. 1-6. The sensors on the drill string (e.g., at the mid-string dynamic subs 110 or the BHA Dynamic Sub 114) acquire acceleration data sent to the processor 103. In a transformation step 701, the processor determines centers of rotation on the drill string based on the acceleration sensed per revolution for each of the centers. Such determination may include transforming the acceleration data into drill string motions and fitting the motions per revolution to respective ellipses, which centers estimate the centers of single rotations on the drill string.

A whirl determination step 701 includes fitting the centers to a closed curved shape, such as another ellipse referred to herein as a whirl ellipse, and outputting at least one whirl attribute upon determining magnitude, orientation, velocity and/or type of drill string whirl. Determining the magnitude, orientation and/or velocity of the drill string whirl utilizes coefficients derived from the whirl ellipse. Further, determining type of whirl, e.g., forward or backward, relies on vector direction of the centers determined in succession.

The processor may output to a user the whirl attribute on a display of the processor 103 or other remote location for monitoring drilling performance. In some embodiments, the output of the whirl attribute results in automatic or user controlled stopping and restarting of drilling, adjusting weight on bit, changing drill string rotation rate, drill bit replacement and/or adjusting drill string stiffness. Such mitigation efforts may continue based on feedback from the output of the whirl attribute until the output of the whirl attribute reaches an acceptable level to avoid or limit tool failures.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

What is claimed is:

1. A method of determining a whirl attribute of a drill string, comprising:

estimating centers of rotation on the drill string based on acceleration sensed per revolution for each of the centers being estimated, wherein the estimating of the centers includes transforming the acceleration sensed to drill sting motions through a numerical optimization utilizing an iterative search to find a drill string position that minimizes an objective function for the drill string position; and determining the whirl attribute from information provided by the centers of rotation to output the whirl attribute selected from at least one of magnitude, orientation, velocity and type of whirl.

2. The method of claim 1, further comprising fitting the centers to a closed curved shape.

3. The method of claim 1, further comprising fitting the centers to a whirl ellipse with coefficients of the whirl ellipse used in the determining to provide the magnitude, orientation and velocity of the whirl.

4. The method of claim 1, further comprising fitting at least five of the centers to a whirl ellipse with coefficients of the whirl ellipse used in the determining to provide the magnitude, orientation and velocity of the whirl.

5. The method of claim 1, wherein the determining of the whirl attribute includes applying vector direction to consecutive ones of the centers to provide the type of the whirl.

6. The method of claim 1, further comprising fitting the centers to a whirl ellipse to provide:

the magnitude determined as a function of semi-major and semi-minor axis of the whirl ellipse, radius of the drill string and whirl angular velocity derived from the centers of rotation on the drill string.

7. The method of claim 1, wherein:

the estimating of the centers includes transforming the acceleration sensed to drill sting motions and fitting the motions per revolution to respective revolution ellipses having elliptical central positions defining at least five of the centers of rotation; and the determining of the whirl attribute includes fitting the centers to a whirl ellipse with coefficients of the whirl ellipse used to provide the magnitude, orientation and velocity of the whirl.

8. The method of claim 1, wherein the determining of the whirl attribute includes continuous updating using the centers from new revolutions of the drill string.

9. The method of claim 1, further comprising changing a drilling condition in response to the whirl attribute determined.

10. The method of claim 1, wherein the numerical optimization searches for the drill string position (P) that satisfies the acceleration detected utilizing an iterative search on P to find the P that minimizes the objective function defined as:

$$J(P) = \left\| \frac{\partial^2 P(t)}{\partial t^2} - a(t) \right\|^2 + \lambda D(P),$$

where t is travel time of the drill string motion, a represents the acceleration detected, D(P) is a damping function, and λ is a constant scaler.

11. A system for determining a whirl attribute of a drill string, comprising:

a drilling rig coupled to the drill string extending into a borehole;

a sensor disposed on the drill string to detect acceleration; and a processor coupled to receive data from the sensor and configured to determine the whirl attribute by estimating centers of rotation on the drill string based on the data per revolution for each of the centers being estimated and deriving from the centers of rotation at least one of magnitude, orientation, velocity and type of whirl, wherein the processor transforms the data to drill sting motions through a numerical optimization utilizing an iterative search to find a drill string position that minimizes an objective function for the drill string position and fits the motions per revolution to respective revolution ellipses.

12. The system of claim 11, wherein the processor fits the centers to a closed curved shape.

13. The system of claim 11, wherein the processor fits the centers to a whirl ellipse and derives the magnitude, orientation and velocity of the whirl from coefficients of the whirl ellipse.

14. The system of claim 11, wherein the processor fits at least five of the centers to a whirl ellipse and derives the magnitude, orientation and velocity of the whirl from coefficients of the whirl ellipse.

15. The system of claim 11, wherein the processor determines the type of the whirl from vector direction applied to consecutive ones of the centers.

16. The system of claim 11, wherein the processor receives the data updated using the centers from new revolutions of the drill string for continuous determination of the whirl attribute.

17. The system of claim 11, wherein the processor is configured to:

transform the acceleration sensed to drill sting motions and fit the motions per revolution to respective revolution ellipses having elliptical central positions defining at least five of the centers of rotation; and fit the centers to a whirl ellipse with coefficients of the whirl ellipse applied to derive the magnitude, orientation and velocity of the whirl.

18. The system of claim 11, wherein the processor further provides a command signal for changing a drilling condition in response to the whirl attribute determined.

19. The system of claim 11, wherein the processor fits the centers to a whirl ellipse to provide:

the magnitude determined as a function of semi-major and semi-minor axis of the whirl ellipse, radius of the drill string and whirl angular velocity derived from the centers of rotation on the drill string.

20. The system of claim 11, wherein the numerical optimization searches for the drill string position (P) that satisfies the acceleration detected utilizing an iterative search on P to find the P that minimizes the objective function defined as:

$$J(P) = \left\| \frac{\partial^2 P(t)}{\partial t^2} - a(t) \right\|^2 + \lambda D(P),$$

where t is travel time of the drill string motion, a represents the acceleration detected, D(P) is a damping function, and λ is a constant scaler.

* * * * *